US006604579B2

(12) United States Patent
Carlin

(10) Patent No.: US 6,604,579 B2
(45) Date of Patent: Aug. 12, 2003

(54) PRESSURE ACTIVATED INJECTION PROBE

(75) Inventor: Mike B. Carlin, Salina, KS (US)

(73) Assignee: Kejr, Inc., Salina, KS (US)

( * ) Notice: Subject to any disclaimer, the term of this patent is extended or adjusted under 35 U.S.C. 154(b) by 0 days.

(21) Appl. No.: 10/037,624

(22) Filed: Jan. 3, 2002

(65) Prior Publication Data

US 2003/0121654 A1 Jul. 3, 2003

(51) Int. Cl.[7] ..... E21B 33/02
(52) U.S. Cl. ..... 166/100; 166/88.1; 175/21
(58) Field of Search ..... 166/100, 303.1, 166/373, 88.1, 75.15; 175/21, 59; 73/864.74

(56) References Cited

U.S. PATENT DOCUMENTS 4,640,355 A 2/1987 Hong et al. ..... 166/269
4,807,707 A * 2/1989 Handley et al.
4,814,608 A * 3/1989 Dempsey et al.
5,062,486 A * 11/1991 McClenahan
5,319,878 A * 6/1994 Moffett et al.
5,319,959 A * 6/1994 Cooper et al.
5,358,057 A * 10/1994 Peters et al.
5,464,059 A 11/1995 Kristiansen ..... 166/269
5,743,343 A * 4/1998 Heller et al.
5,802,996 A * 9/1998 Baxter

OTHER PUBLICATIONS

ESP Injection Check Valve information located at www.envservprod.com, an Internet site of Environmental Service Products, Laguana Hills, California (2001).

* cited by examiner

*Primary Examiner*—Roger Schoeppel
(74) *Attorney, Agent, or Firm*—Jeffrey L. Thompson; Thompson & Thompson, P.A.

(57) ABSTRACT

An injection probe assembly is disclosed for injecting material into subsurface formations for making geotechnical improvements. The probe assembly includes a sheath having an upper end for attaching to a mating tool string and a lower end for receiving a solid drive point. The sheath has a reduced diameter injection area which includes an interior space enclosed by a tubular sidewall, a valve seat, and a plurality of injection ports extending through the sidewall through which materials can be injected laterally. A check valve spool is arranged for sliding movement within the interior space for preventing back-flow of material into the interior space. The spool is seated on the valve seat and covers the injection ports in a first position, and is unseated from the valve seat with the injection ports uncovered in a second position. The spool is responsive to pressure changes of the injected materials.

20 Claims, 4 Drawing Sheets

PRESSURE ACTIVATED INJECTION PROBE

BACKGROUND OF THE INVENTION

1. Field of the Invention

The present invention relates generally to devices for injecting materials into the earth's subsurface. In particular, the present invention relates to drivable probes used for injecting materials into the subsurface for remediating soil and ground water contamination, stabilizing soil, and making other geotechnical improvements.

2. Description of the Related Art

The use of direct push techniques to inject chemicals into the subsurface for the remediation or clean up of contaminated ground water and soil gained notoriety in the mid to late 1990s. The use of small diameter tools as a conduit to deliver remediation materials into contaminated, subsurface zones can be an efficient method to remediate contaminated soils.

To date, the bulk of injection work is being done with equipment and techniques designed for hole abandonment grouting. As shown in FIG. 1, this particular technique uses a probe assembly 10 having a point 11 that closes off the leading end 12 of the tool string 13. After the initial investigation (e.g., soil sampling, ground water sampling, etc.) the open probe hole 14 must be properly sealed with a suitable grout mix 15 to prevent migration of contaminated soils throughout the probe hole 14.

The conventional tool string 13 is first advanced to the bottom of the open probe hole 14. The tool string 13 is then retracted allowing the point 11 (often referred to as the "expendable point") to fall off leaving the inside diameter ("ID") of the tool string 13 open to the soil. A grout mix 15 is then pumped through the ID of the tool string 13 as the tool string 13 is retracted out of the probe hole 14. The probe hole 14 is filled to the top as the tool string 13 is retracted. This particular approach is commonly referred to as "bottom up grouting."

Remediation materials are often delivered in this same manner. The problem with injecting remediation materials with this technique is ensuring that the material is evenly injected into the soil throughout the entire injection interval. As the tool string 13 is retracted and material is being injected, the resistance to material flow into the soil will change as the geological characteristics change. This can lead to more material being injected into zones. 16, 18 with less resistance to flow and less material going into zones 17 with a higher resistance to flow. For this reason, the use of a "top down injection" approach is more advantageous.

FIG. 2 illustrates an injection probe assembly 20 for use in a top down injection technique. The top down injection approach uses a reduced diameter injection area 21 along the sheath 22 of the probe assembly 20 to define an injection interval. The defined injection area 21 on the sheath 22 eliminates the open hole below the tool string where the injected material would be exposed to differing soil with varying resistances to flow, as in the bottom up grouting and injection techniques shown in FIG. 1. The top down injection approach ensures that the material is being injected evenly over the entire injection interval.

A difficulty in top down injection techniques is the lack of tooling available for such an approach. Since the injection takes place during several advancements of the tool string 24, clogging of the sheath 22 or the tool string 24 is often a problem. In addition to clogging, the soil around the injection point 25 can resist flow, causing pressure to build up in the soil formation and inside the tool string 24. This excess formation pressure causes the material 23 being injected to flow back up through the tool string 24 where it is displaced through the top of the tool string 24 and spills onto the ground at the top of the probe hole.

Thus, there is a need in the industry for an improved tool string for use in top down injection techniques which eliminates clogging and prevents back-flow of injection material.

SUMMARY OF THE INVENTION

It is an object of the present invention to provide an injection probe that solves the above-described problems with existing top down injection techniques.

It is a further object of the present invention to provide an injection probe that ensures material is injected evenly over the desired interval, that prevents the tool string from clogging during normal string advancement, and that prevents back-flow of the injection material up the tool string when pressure develops within the soil formation.

It is a further object of the present invention to provide an improved pressure activated injection probe that can be used effectively to provide uniform top down injection into the subsoil without clogging, and that is economical to manufacture, capable of a long operating life, and particularly well suited for use in remediating contaminated soils and ground water.

In order to solve the problems with the prior art described above, the applicant has developed an improved pressure activated injection probe assembly for injecting materials into subsurface formations to remediate contaminated soils and ground water, to inject grout materials for soil stabilization, and for making other geotechnical improvements. The probe assembly includes a sheath having an upper end for attaching to a mating tool string and a lower end for receiving a solid drive point. The sheath has a reduced diameter injection area which includes an interior space enclosed by a tubular sidewall, a valve seat, and at least one and preferably a plurality of injection ports extending through the sidewall through which materials can be injected laterally. A check valve spool is arranged for sliding movement within the interior space of the sheath for preventing clogging and back-flow of material into the interior space. The valve spool has a first closed position in which an upper end thereof is seated on the valve seat and an outer cylindrical surface covers the inner sides of the injection ports. The valve spool has a second open position in which the upper end is unseated from the valve seat and the injection ports are open to the interior space. The valve spool is biased toward its closed position by a compression spring, and is responsive to pressure changes within the sheath for movement between the closed and open positions.

According to a broad aspect of the present invention, an injection probe is provided, comprising: a tubular assembly having an upper end for attaching to a mating tool string, a lower end for receiving a solid drive point, an upper seal portion adjacent to the upper end, a lower seal portion adjacent to the lower end, and an injection area between the upper and lower seal portions. The injection area has a smaller outer diameter than the upper and lower seal portions, an interior space enclosed by a tubular sidewall, a valve seat, and at least one and preferably a plurality of injection ports extending through the sidewall through which materials can be injected laterally into a subsurface formation. A check valve spool is arranged for sliding movement within the interior space of the injection area for preventing back-flow of material into the interior space. The check valve spool has a first position in which an end portion of the check valve spool is seated on the valve seat and an outer surface of the check valve spool covers the injection ports and prevents material from flowing back into the interior space through the injection ports. The valve spool has a second position in which the end portion of the check valve spool is unseated from the valve seat and the injection ports are open to the interior space.

Numerous other objects of the present invention will be apparent to those skilled in this art from the following description wherein there is shown and described a preferred embodiment of the present invention, simply by way of illustration of one of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE PREFERRED EMBODIMENT

Figure 1:
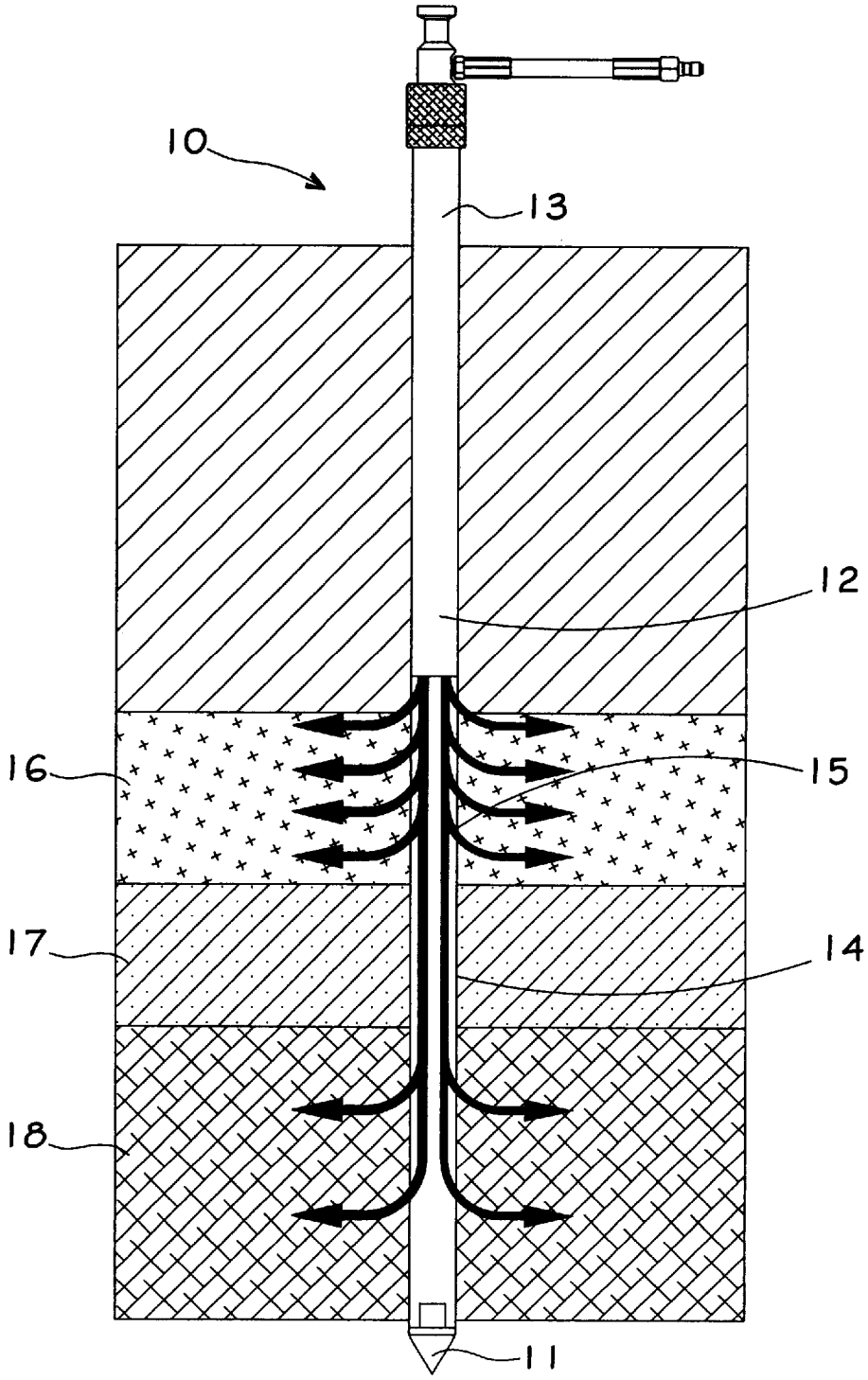
Fig. 1 (Prior Art)
FIG. 1 is a cross section view providing an overview of conventional "bottom up" grouting and injection techniques.
Figure 2:
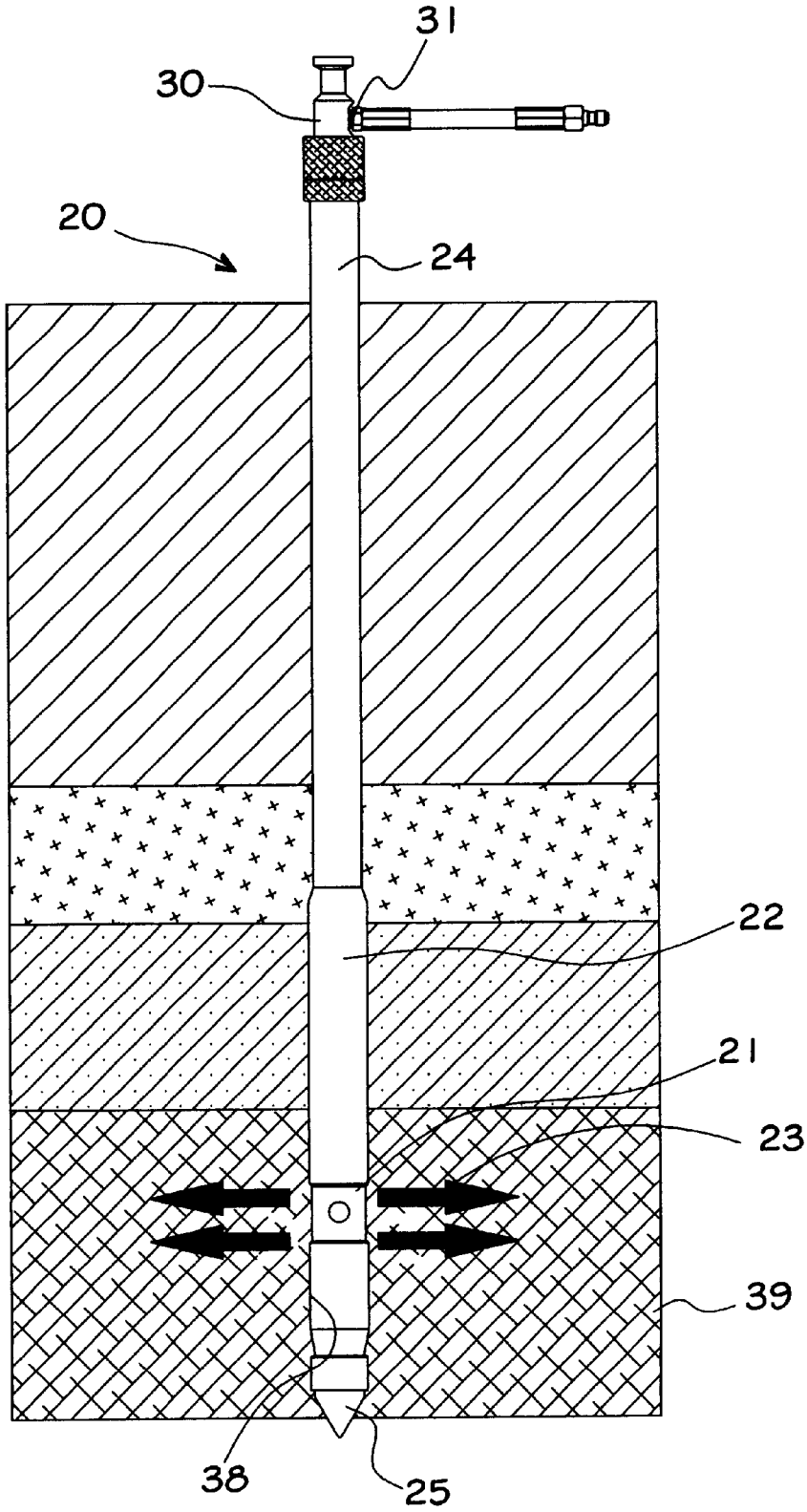
FIG. 2 is a cross section view providing an overview of a "top down" injection technique.
Figure 3:
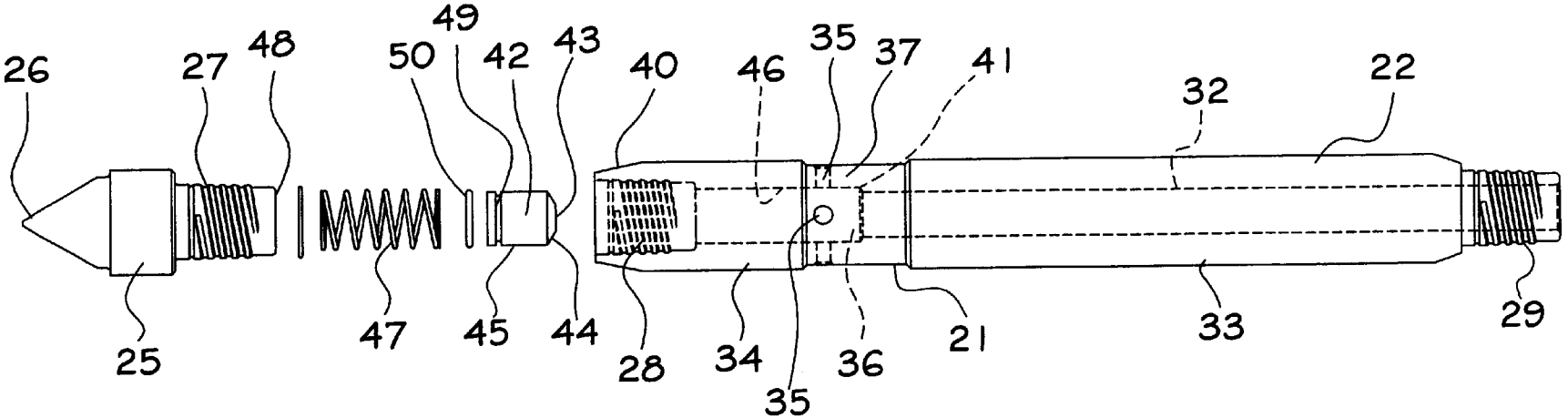
FIG. 3 is an exploded front view of a pressure activated injection probe assembly of the present invention.
Figure 4:
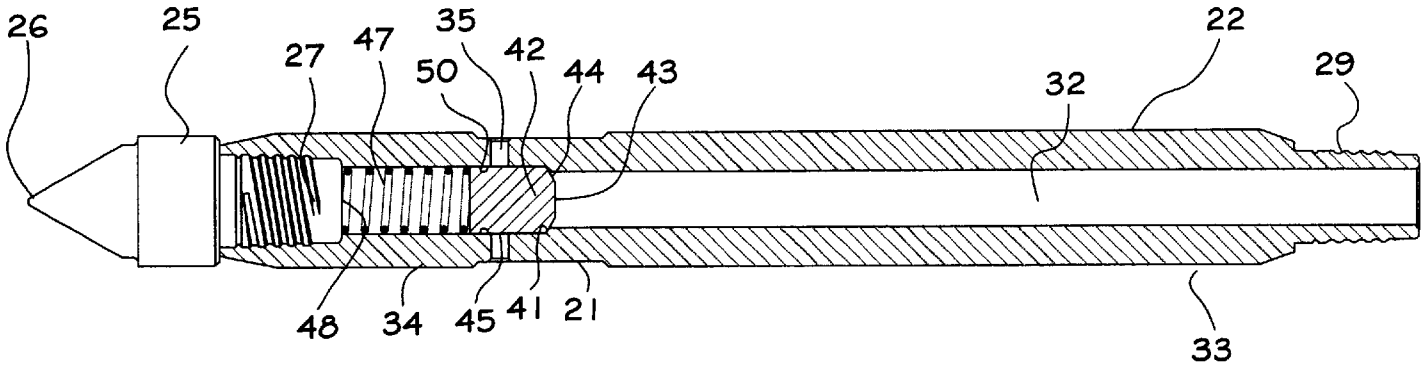
FIG. 4 is a partially cutaway front view of the pressure activated injection probe of the present invention with a check valve closed to prevent soil and other material from entering the probe.
Figure 5:
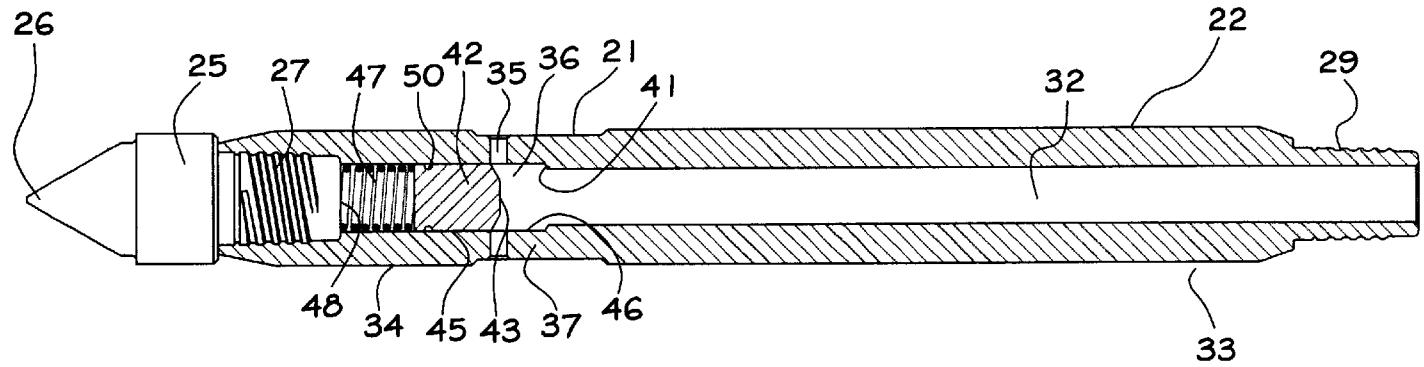
FIG. 5 is a partially cutaway front view of the pressure activated injection probe of the present invention with the check valve open to allow material to flow out of the injection ports.

A pressure activated injection probe assembly 20 according to a preferred embodiment of the present invention will now be described with reference to FIGS. 2 to 5 of the accompanying drawings.

The injection probe assembly 20 includes a tool string 24, an injection probe sheath 22, and a solid drive point 25. The solid drive point 25 includes a conical-shaped tip 26 that tapers to a point, and a male-threaded mating portion 27 adapted to be received in a female-threaded opening 28 at the lower end of the sheath 22. The tool string 24 is attached to an upper end of the sheath 22 using a suitable mating connection. For example, the sheath 22 can be provided with male threads 29 at its upper end, and the tool string 24 can be provided with corresponding female threads at its lower end to make raw the mating connection.

The tool string 24 comprises a plurality of probe rods which are attachable together to form different working lengths. For example, the probe rods forming the tool string 24 may be provided in several short lengths which are attachable together end-to-end in a series to form a variable working length. As the probe sheath 22 and drive point 25 are driven vertically into the ground during use, additional probe rods can be added to the top of the tool string 24. When the sheath 22 and drive point 25 are at the desired depth, a manifold 30 is attached to an upper end of the tool string 24. The manifold 30 includes a port 31 for introducing materials to be injected into a longitudinal bore of the tool string 24. Materials to be injected can thus be pumped through the tool string 24 to a longitudinal inner passage 32 of the sheath 22.

The sheath 22 includes an upper seal portion 33 adjacent to the upper end, a lower seal portion 34 adjacent to the lower end, and a reduced diameter injection area 21 between the upper and lower seal portions 33, 34. The injection area 21 has at least one and preferably a plurality of injection ports 35 extending from a hollow interior space 36 of the sheath 22 through a tubular sidewall 37 thereof through which materials can be injected laterally. In a preferred embodiment, four injection ports 35 of approximately 0.25 inch diameter each are spaced evenly around the injection area 21 approximately 90 degrees apart from each other.

The injection area 21 has a smaller outer diameter than the upper and lower seal portions 33, 34. The outer diameters of the upper and lower seal portions 33, 34 of the sheath 22 corresponds with the size of the bore 38 through the subsurface formation 39 created by the drive point 25 and the tapered lower edge 40 of the sheath 22. As a result, the upper and lower seal portions 33, 34 fit snugly against the subsurface formation 39 in which the probe assembly 20 is placed, and containment seals are created above and below the injection area 21. The containment seals created by the upper and lower seal portions 33, 34 enhance the precision and uniformity of the injection at each injection interval.

A valve seat 41 is machined within the sheath 22 above the injection ports 35. The valve seat 41 is located between the hollow interior space 36 of the injection area 21 and the inner passage 32 of the upper portion of the sheath 22.

A check valve spool 42 is arranged for sliding movement within the interior space 36 of the injection area 21. The check valve spool 42 is a generally cylindrical member formed of a polyethylene material having an upper end 43 with a tapered edge 44 adapted to engage and seal against the valve seat 41. The cylindrical outer surface 45 of the check valve spool 42 is slidably received within the cylindrical inner surface 46 of the tubular sidewall 37 of the sheath 22 with a close tolerance fit (e.g., 0.005" inch).

The check valve spool 42 has a first "closed" position (FIG. 4) in which the tapered edge 44 of the upper end 43 of the check valve spool 42 is seated on the valve seat 41. The seal created between the check valve spool 42 and the valve seat 41 prevents fluid from flowing back up through the inner passage 32 of the sheath 22 and the bore of the tool string 24 when positive pressure is encountered within the soil formation 39. The outer surface 45 of the check valve spool 42 also covers the inner sides of the injection ports 35 in this first position and prevents soil and other foreign material from flowing back into the interior space 36 through the injection ports 35. Since soil can only enter the injection ports 35, and not the interior space 36 of the sheath 22, the system will not plug during nonpumping periods.

The check valve spool 42 has a second "open" position (FIG. 5) in which the upper end 43 of the check valve spool 42 is unseated from the valve seat 41 and the injection ports 35 are open to the interior space 36. The valve spool 42 is movable from the first position to the second position when a sufficient positive fluid pressure exists within the inner passage 32 of the sheath as material is pumped through the tool string 24.

A compression spring 47 is arranged within the sheath 22 near a lower end thereof to engage and bias the check valve spool 42 toward the check valve seat 41. The spring 47 operates to move the check valve spool 42 from the second open position back to the first closed position when a positive pressure ceases to exist within the inner passage 32 of the sheath 22. The spring constant of the spring 47 is sufficient to maintain the check valve spool 42 in the first position until a predetermined positive pressure is introduced into the sheath 22, and also to overcome frictional forces in returning the valve spool 42 from the second open position to the first closed position. A lower end of the spring 47 is seated against an inner surface 48 of the solid drive point 25. In a preferred embodiment, the spring 47 is made of stainless steel.

The check valve spool 42 has an annular groove 49 formed in the cylindrical portion near a lower end thereof. An O-ring 50 is positioned in the annular groove 49 to create a seal between the valve spool 42 and the inner surface 46 of the sheath 22. The O-ring 50 prevents soil and other foreign material from flowing around the check valve spool 42 into the lower portion of the sheath 22, where it would interfere with the operation of the spring 47.

The injection probe 20 is assembled by placing the O-ring 50 on the check valve spool 42, sliding the valve spool 42 through the lower end of the sheath 22 and into the interior space 36 of the injection area 21, inserting the compression spring 47 through the lower end of the sheath 22 into engagement with the check valve spool 42, and threading the drive point 25 into the mating female threads 28 at the lower end of the sheath 22. The assembly process can therefore be accomplished quickly and easily.

In operation, the injection probe assembly 20 is driven vertically into the ground to a desired depth in a subsurface formation 39. The injection area 21 of the sheath 22 is aligned with the subsurface formation 39 to be treated. Material is then pumped through the tool string 24 into the sheath 22. When the positive pressure of the material in the inner passage 32 above the valve spool 42 overcomes the spring force of the compression spring 47, the valve spool 42 shifts off of the valve seat 41 and the injection ports 35 are exposed. This allows material to flow laterally out of the injection ports 35 of the sheath 22 and into the subsurface formation 39. When positive pressure is decreased or eliminated from the inner passage 32 of the sheath 22, the spring 47 moves the valve spool 42 back against the valve seat 41, thus eliminating back flow through the injection ports 35. The cylindrical outer surface 45 of the valve spool 42 blocks the injection ports 35 in this position. The injection probe assembly 20 can then be advanced to the next injection interval with the injection ports 35 closed to prevent clogging of the assembly.

It will be appreciated that certain features of the present invention described above can be changed without departing from the scope of the invention. For example, the valve spool 42 can be formed of a material other than polyethylene to maintain chemical compatibility with different injection materials. In conditions where driving the tool string will be very difficult and.require extensive percussion on the tool string, a hardened steel check valve spool 42 may be used. Also, the size and number of the injection ports 35 can be increased or decreased to accommodate different material viscosity and flow rates.

While the invention has been specifically described in connection with specific embodiments thereof, it is to be understood that this is by way of illustration and not of limitation, and the scope of the appended claims should be construed as broadly as the prior art will permit.

What is claimed is:

1. An injection probe assembly, comprising:

a tubular sheath having upper and lower ends and an injection area between the upper and lower ends, the injection area having a hollow interior space enclosed by a tubular sidewall and at least one injection port extending through the sidewall for allowing materials to be injected laterally through the injection port into a subsurface formation; and a check valve spool located within the hollow interior space of the injection area for preventing back-flow of material into the interior space, the check valve spool having a first position in which the injection port is closed to the hollow interior space, and a second position in which the injection port is open to the hollow interior space.

2. The injection probe assembly according to claim 1, further comprising an upper seal portion between the injection area and the upper end, and a lower seal portion between the injection area and the lower end, the upper and lower seal portions each having a larger outer diameter than an outer diameter of the injection area to create respective seals above and below the injection port during operation.

3. The injection probe assembly according to claim 1, further comprising a spring arranged within the sheath to engage and bias the check valve spool toward a check valve seat located within the sheath above the injection port.

4. The injection probe assembly according to claim 1, wherein said check valve spool is slidably received within the interior space of the injection area with a close tolerance fit between an outer surface of the check valve spool and an inner surface of the tubular sidewall of the sheath.

5. The injection probe assembly according to claim 1, wherein said check valve spool has a generally cylindrical portion having a cylindrical outer surface that corresponds in size to a cylindrical inner surface of the sidewall of the injection area through which the injection port extends.

6. The injection probe assembly according to claim 5, wherein said check valve spool has an annular groove formed in said cylindrical portion near a lower end thereof, and an O-ring positioned in said annular groove to prevent material from flowing around said check valve spool.

7. The injection probe assembly according to claim 1, wherein said check valve spool is slidable from said first position to said second position against the bias of a spring.

8. The injection probe assembly according to claim 1, wherein the sheath has an inner passage extending from the upper end to the injection area for delivering materials to be injected to the injection area, and a check valve seat located between the inner passage and the injection area, said check valve spool engaging the check valve seat and closing the inner passage from the injection area in its first position.

9. The injection probe assembly according to claim 8, wherein said check valve spool is slidable from said first position to said second position against a spring bias when a positive pressure is introduced into the inner passage of the sheath.

10. An injection probe assembly, comprising:

a tool string;

a drive point; and a sheath having upper and lower ends, the upper end being mated to the tool string, and the drive point being received in the lower end, the sheath further comprising:

an injection area between the upper and lower ends having a hollow interior space enclosed by a tubular sidewall and at least one injection port extending through the sidewall for allowing materials to be injected laterally through the injection port into a subsurface formation; and a check valve spool located within the hollow interior space of the injection area for preventing back-flow of material into the interior space, the check valve spool having a first position in which the injection port is closed to the hollow interior space, and a second position in which the injection port is open to the hollow interior space.

11. The injection probe assembly according to claim 10, wherein said drive point includes a conical-shaped tip and a male threaded mating portion which is received in a female threaded mating portion at the lower end of the sheath.

12. The injection probe assembly according to claim 10, wherein the check valve spool is arranged for sliding movement within the interior space of the injection area, and the check valve spool has an end portion facing a valve seat within the sheath, said end portion of the check valve spool being seated against the valve seat with an outer surface of the check valve spool blocking the injection port in said first position, and said end portion of the check valve spool being unseated from the valve seat with the injection port open to the interior space in said second position.

13. The injection probe assembly according to claim 12, wherein said check valve spool is responsive to fluid pressure within the sheath for movement between the first and second positions.

14. An injection probe, comprising:

a tubular assembly having an upper end for attaching to a mating tool string, a lower end for receiving a solid drive point, an upper seal portion adjacent to the upper end, a lower seal portion adjacent to the lower end, and an injection area between the upper and lower seal portions;

the injection area having a smaller outer diameter than the upper and lower seal portions, an interior space enclosed by a tubular sidewall, a valve seat, and at least one injection port extending through the sidewall through which materials can be injected laterally into a subsurface formation; and a check valve spool arranged for sliding movement within the interior space of the injection area for preventing back-flow of material into the interior space, the check valve spool having a first position in which an end portion of the check valve spool is seated on the valve seat and an outer surface of the check valve spool covers the injection port and prevents material from flowing back into the interior space through the injection port, and a second position in which the end portion of the check valve spool is unseated from the valve seat and the injection port is open to the interior space.

15. The injection probe according to claim 14, further comprising a compression spring positioned within the sheath and arranged to engage and bias the check valve spool toward the valve seat.

16. The injection probe according to claim 15, further comprising an O-ring positioned on the check valve spool near an end thereof opposite the end portion facing the valve seat, said O-ring being arranged to create a seal between the outer surface of the check valve spool and an inner surface of the sheath to keep foreign material away from the compression spring.

17. The injection probe according to claim 15, wherein said compression spring has first and second ends, the first end engages the check valve spool, and the second end is seated against an inner surface of the drive point.

18. The injection probe according to claim 14, wherein said at least one injection port comprises a plurality of injection ports spaced circumferentially about the injection area.

19. The injection probe according to claim 14, wherein said check valve spool is responsive to fluid pressure within the sheath for movement between the first and second positions.

20. The injection probe according to claim 14, wherein said check valve spool is formed of a polyethylene material.

* * * * *